United States Patent [19]

Ogino et al.

[11] Patent Number: 4,595,814

[45] Date of Patent: Jun. 17, 1986

[54] INDUCTION HEATING APPARATUS UTILIZING OUTPUT ENERGY FOR POWERING SWITCHING OPERATION

[75] Inventors: Yoshio Ogino; Takumi Mizukawa, both of Osaka; Hideki Ohmori, Kawanishi; Hirokazu Yoshida, Osaka, all of Japan

[73] Assignee: Matsushita Electric Industrial Co., Ltd., Japan

[21] Appl. No.: 524,436

[22] Filed: Aug. 18, 1983

[30] Foreign Application Priority Data

Aug. 19, 1982 [JP] Japan ..... 57-125565[U]
Sep. 28, 1982 [JP] Japan ..... 57-170104

[51] Int. Cl.[4] ..... H05B 6/06

[52] U.S. Cl. ..... 219/10.77; 219/10.49 R; 363/21; 363/97

[58] Field of Search ..... 219/10.77, 10.75, 10.49 R, 219/10.67; 363/21, 97

[56] References Cited

U.S. PATENT DOCUMENTS

| | | | |
|---|---|---|---|
| 3,686,558 | 8/1972 | Havas et al. | 219/10.77 X |
| 3,742,179 | 6/1973 | Harnden, Jr. | 219/10.77 |
| 4,115,676 | 9/1978 | Higuchi et al. | 219/10.49 R |
| 4,210,827 | 7/1980 | Kanazawa et al. | 219/10.55 B |
| 4,277,667 | 7/1981 | Kiuchi | 219/10.49 X |
| 4,317,975 | 3/1982 | Mizukawa et al. | 219/10.77 X |
| 4,334,135 | 6/1982 | Smith | 219/10.49 R |
| 4,356,371 | 10/1982 | Kiuchi et al. | 219/10.77 |

FOREIGN PATENT DOCUMENTS

| | | |
|---|---|---|
| 2430679 | 2/1980 | France . |
| 1472492 | 5/1977 | United Kingdom . |
| 1491415 | 11/1977 | United Kingdom . |
| 2073967 | 10/1981 | United Kingdom . |

*Primary Examiner*—Philip H. Leung
*Attorney, Agent, or Firm*—Lowe, Price, LeBlanc, Becker & Shur

[57] ABSTRACT

An induction heating apparatus comprises a rectifier (2) for rectifying a voltage from an AC mains supply, a resonance circuit formed by an induction heating coil (4) and a capacitor (4), a semiconductor switching device (6) connected in circuit with the resonance circuit to the output of the rectifier, a diode (7) coupled in anti-parallel relationship with the switching device (6), and a circuit (17; 117, 118) for driving the switching device into conduction at a controlled frequency. Further provided is a transformer (14) which derives a low-frequency energy from the AC mains supply (1). A second coil (9) is electromagnetically coupled with the heating coil (4) for deriving a high-frequency energy. The low- and high-frequency energies are coupled by diodes (10, 11, 15, 16; 132, 133) to the driving circuit to provide power necessary to effect the conduction of the switching device.

11 Claims, 7 Drawing Figures

INDUCTION HEATING APPARATUS UTILIZING OUTPUT ENERGY FOR POWERING SWITCHING OPERATION

BACKGROUND OF THE INVENTION

The present invention relates to an induction heating apparatus which saves power by utilizing its own high frequency energy for switching operation.

Induction heating involves conversion of energy from an AC mains supply to high frequency energy and the amount of energy involved in the conversion is substantial. Use is made of a semiconductor switching device whose on-off switching operation causes a resonant circuit to oscillate at a frequency in the ultrasonic range. Due to the substantial amount of energy involved in the switching operation, the switching device needs to carry a heavy current. This creates a need for a drive circuit capable of delivering a sufficient amount of energy to the switching device and a power circuit for the drive circuit must meet such power requirement. This requirement is currently met by a large transformer and a number of capacitors of large capacitance value. Use of such components constitutes a barrier to making a compact induction heating apparatus.

SUMMARY OF THE INVENTION

It is therefore an object of the invention to provide an induction heating apparatus which is compact, inexpensive to manufacture and consumes less power.

The invention contemplates to utilize part of the high frequency energy of the induction heating apparatus as a source for powering its switching operation.

According to the invention, the induction heating apparatus comprises a rectifier for rectifying a voltage from an AC mains supply, a resonance circuit formed by an induction heating coil and a capacitor, a unidirectionally conductive semiconductor switching device connected in circuit with the resonance circuit to the output of the rectifier, a unidirectionally conducting device coupled in anti-parallel relationship with the switching device, and a circuit for driving the switching device into conduction at a controlled frequency. Further provided are first means which derives a low-frequency energy from the AC mains supply, a second coil electromagnetically coupled with the heating coil for deriving a high-frequency energy, and second means for applying the low- and high-frequency energies to the driving circuit to provide power neccesary to effect the conduction of the switching device.

BRIEF DESCRIPTION OF THE DRAWINGS

The present invention will be described in further detail with reference to the accompanying drawings, in which.

FIGS. *6a* and *6b* are illustrations of the structure of an induction heating coil and a detector coil.

DETAILED DESCRIPTION

Figure 1:
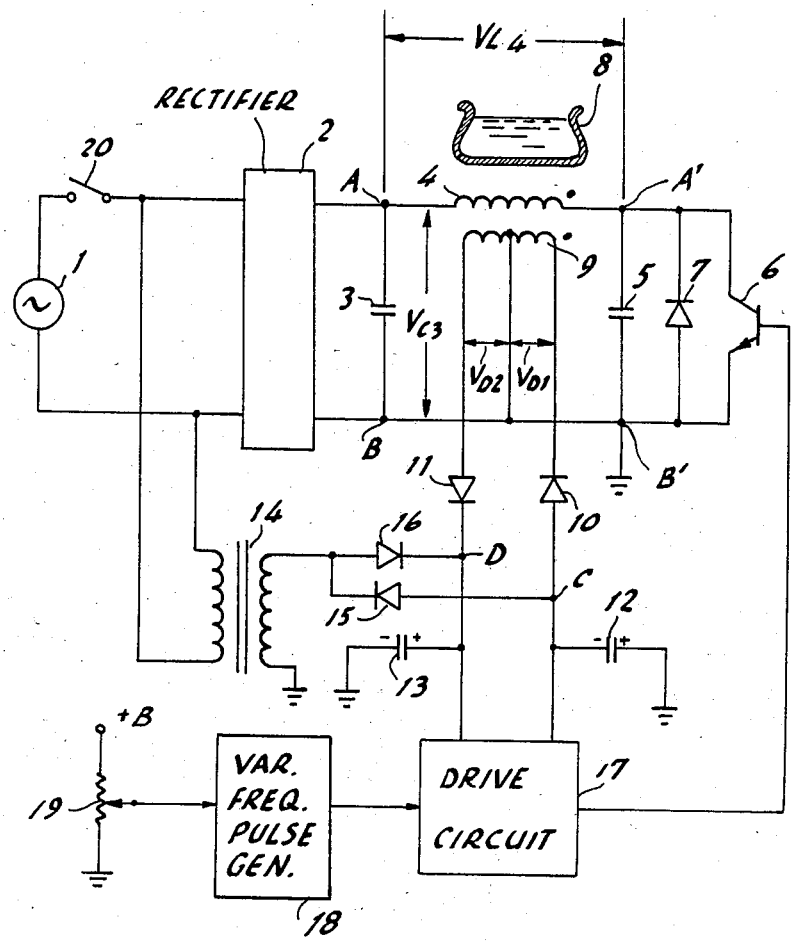
FIG. 1 is a block diagram of a first embodiment of the invention.

Referring now to FIG. 1, there is shown an induction heat cooking apparatus according to a first embodiment of the present invention. The apparatus comprises a full-wave rectifier 2 coupled to an AC mains supply 1 to provide a full-wave rectified, nonfiltered sinusoidal halfwave pulses to an inverter comprising a filter capacitor 3 which is coupled across the output terminals A and B of the rectifier 2 to act as a low-impedance path for the inverter's high frequency current, an induction heating coil 4, a capacitor 5 which forms with the coil 4 a resonant circuit tuned to an ultrasonic frequency, and a switching circuit. This switching circuit is formed by a power-rated switching transistor 6 and a diode 7 connneted in anti-parallel relationship with the transistor 6 across the terminals A′ and B′.

The induction heating coil 4 is of a flat spiral structure mounted below a ceramic cooktop, not shown, on which an inductive utensil 8 is placed in overlying relation with the heating coil 4 to electromagnetically couple with the heating coil 4. A detector coil 9 is inductively coupled with the heating coil 4 with the center tap of coil 9 being coupled to the terminal B which is grounded as at B′. A first terminal of the coil 9 is connected to the cathode of a rectifier diode 10 and a second terminal thereof is connected to the anode of a rectifier diode 11. The anode of the diode 10 is connected to ground by a smoothing capacitor 12 and the cathode of the diode 11 is connected to ground by a smoothing capacitor 13.

A step-down power transformer 14 is provided having its primary winding coupled to the mains supply 1. The secondary winding of the transformer 14 is connected at one end to ground and at the other end to the cathode of a diode 15 whose anode is coupled to the anode of the diode 10 and further coupled to the anode of a diode 16 whose catode is coupled to the cathode of the diode 11. A circuit junction C between diodes 10, 15 and capacitor 12 is coupled as a negative terminal of a DC voltage source to a transistor drive circuit 17 and a circuit junction D between diodes 11, 16 and capacitor 13 is coupled as a positive terminal of the DC voltage source to the drive circuit 17. The output of the transistor drive circuit 17 is connected to the base of the switching transistor 6.

The transistor drive circuit 17 may be any one of conventional designs which amplify the gating pulse from a variable frequency pulse generator 18. This pulse generator is also known in the art which operates with an adjustable voltage source formed by a potentiometer 19 to vary its output frequency. The pulse generator 18 may be of the type having a variable duty ratio which is the function of the adjustable voltage. The potentiometer 19 is controlled by the user to set up a desired power level to which the inverter's output power is controlled by varying the frequency or duty ratio of the trigger pulse supplied to the switching transistor 6.

The operation of the embodiment of FIG. 1 will now be described with reference to waveforms shown in FIG. 2. Illustrated at $VL_4$ is a voltage waveform appearing across the induction heating coil 4 and illustrated at $VC_3$ is a waveform across the capacitor 3. Further illustrated at $VD_1$ and $VD_2$ are voltages developed in the half sections of the coil 9 with respect to the center tap which is grounded. These voltage waveforms are generated during a period $T_1$ in which the inverter is adjusted to a high power setting and during a period $T_2$ in which the power setting is switched to a low level.

When the apparatus is energized in response to the operation of a power switch 20, an AC voltage is developed in the secondary of the step-down transformer 14 and rectified by diodes 15 and 16 and smoothed by capacitors 12 and 13 into negative and positive DC voltages which are applied to the transistor drive circuit 17. The application of these DC voltages to the drive circuit 17 causes the transistor 6 to conduct at a frequency determined by the adjustment at potentiometer 19, so that a high frequency current is generated in the induction heating coil 4 and the voltage $VL_4$ thus appears thereacross. The amount of power supplied initially to the drive circuit 17 is sufficient to cause it to turn the switching transistor 6 into conduction. Once the inverter is triggered into oscillation by the energy supplied from transformer 14, the energy required to sustain the oscillation is supplied from the smoothing capacitors 12 and 13.

Since the heating coil 4 is biased by the voltage VC3, the envelope of the voltage $VL_4$ varies with the rectified voltage $VC_3$ and the amplitude of the negative halfwave assumes a value Va equal to the amplitude of the voltage $VC_3$. Assume that the inverter power level is switched from the high to low setting, the amplitude of positive halfwave of the waveform $VL_4$ reduces to a lower level, whereas the amplitude of its negative halfwave remains unchanged since the bias component $VC_3$ is not affected by power setting.

Figure 2:
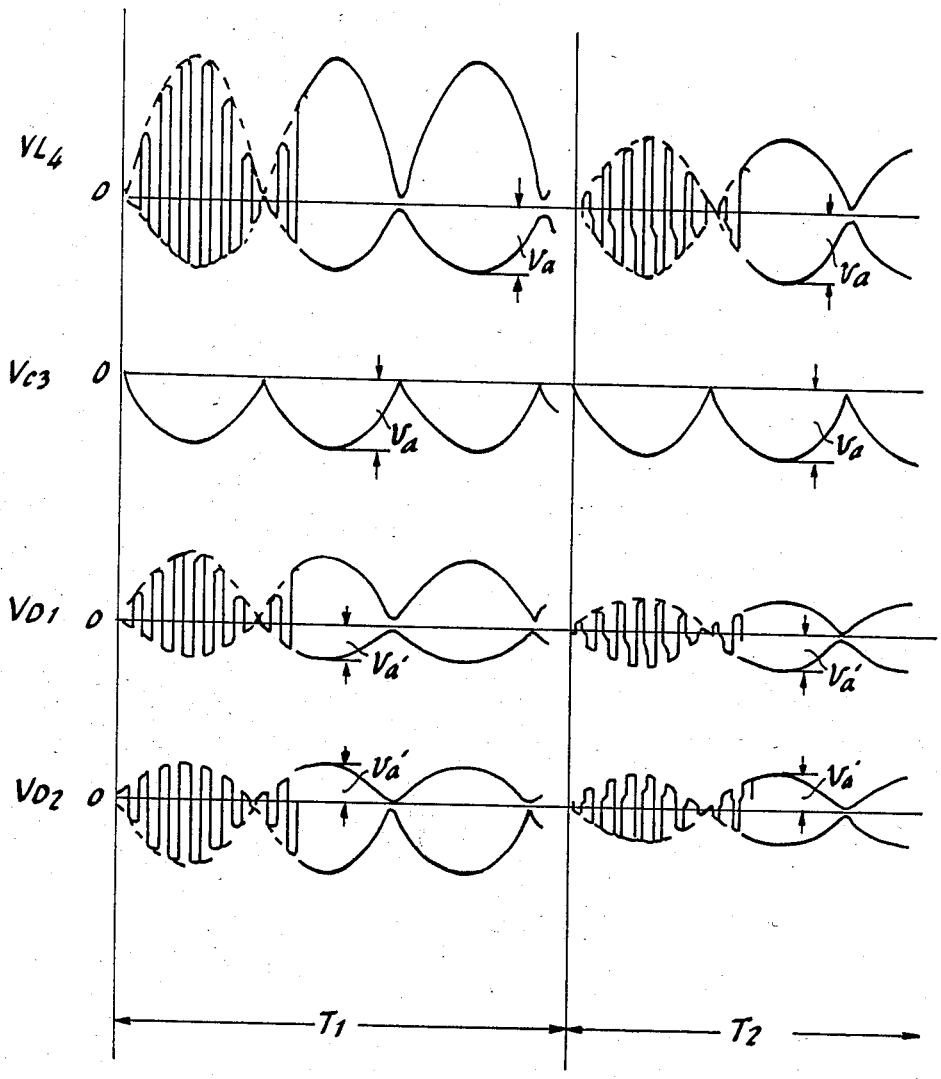
FIG. 2 is a waveform diagram associated with the first embodiment.

As will be seen from FIG. 2, the negative halfwave of the voltage $VD_1$ has an amplitude Va' which is derived from the negative component of the voltage $VL_4$. Likewise, the positive halfwave of the voltage $VD_2$ assumes an amplitude Va' which is attributed to the negative component of $VL_4$. Since the negative component of $VL_4$ remains constant regardless of power setting, the positive and negative voltages developed in the smoothing capacitors 13 and 12 remain constant to allow the transistor drive circuit 17 to operate reliably under a wide range of inverter operations.

While use is made of a step-down transformer for deriving the initial DC power, a voltage divider circuit may be used instead by connecting it across the capacitor 3 to derive such DC power.

Figure 3:
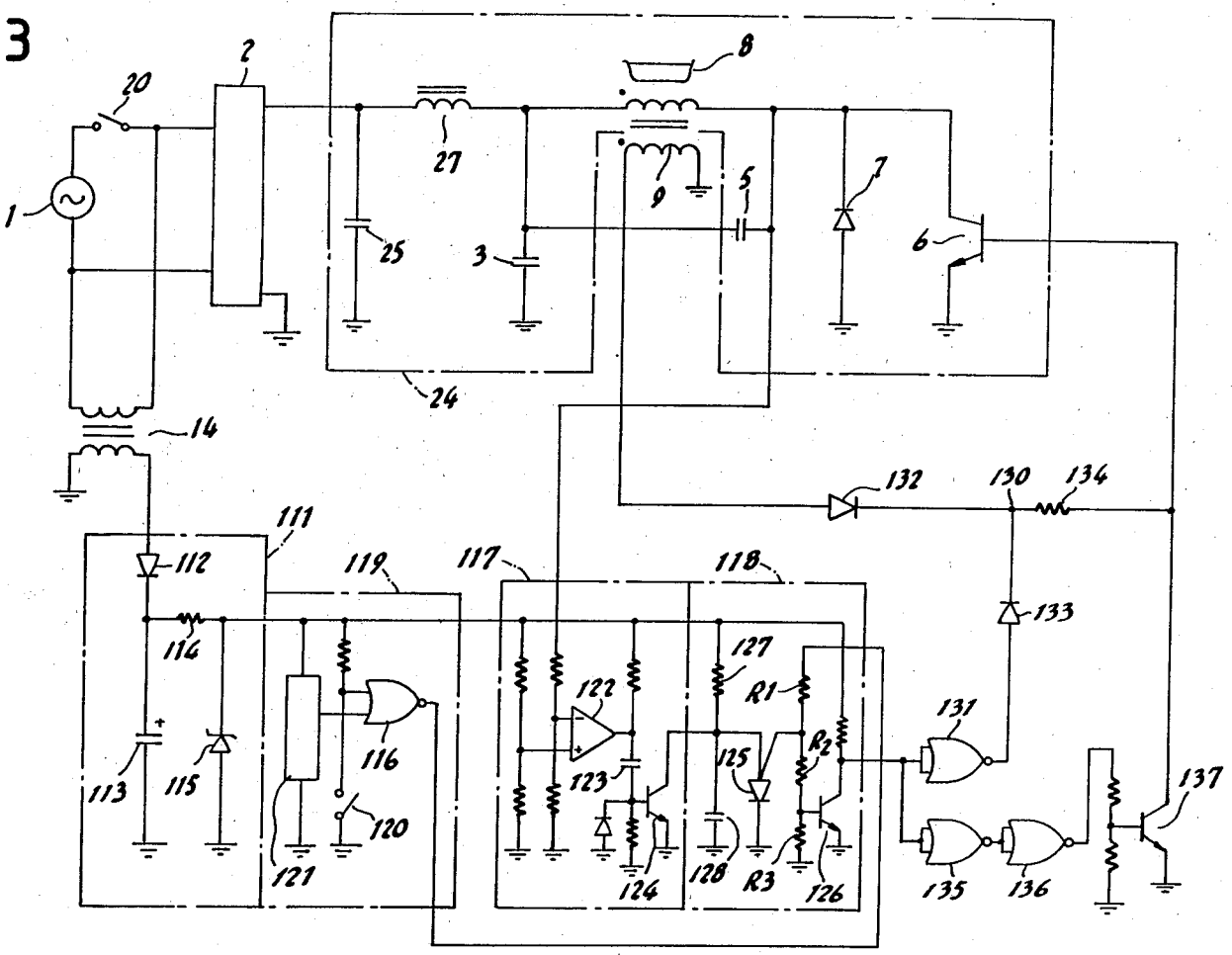
FIG. 3 is a block diagram of a second embodiment of the invention.

FIG. 3 is an illustration of a modified embodiment of the invention in which parts corresponding to those in FIG. 1 are marked with the same reference numerals as used in FIG. 1. The inverter shown at 24 additionally includes an inductor 27 and a capacitor 25 which form a filter circuit with the capacitor 3.

The secondary winding of the step-down transformer 14 is coupled to a DC power circuit 111 which comprises a series circuit formed by a diode 112 and a capacitor 113 which is grounded. A circuit junction between diode 112 and capacitor 113 is further coupled to ground by a circuit including a resistor 114 and a Zener diode 115. The diode 112 and capacitor 113 form a halfwave rectifier circuit and the resistor 114 and Zener diode 115 form a voltage stabilizer. The DC power circuit 111 provides power to a trigger circuit 117, a timing circuit 118 and a safety assurance circuit 119. The trigger circuit 117 and timing circuit 118 are combined to act as a pulse generator for generating the trigger pulse at a controlled frequency for application to the base of transistor 6. The safety assurance circuit 119 includes a switch 120, a protection circuit 121 and a NOR gate 116. The protection circuit 121 is a known circuit that functions to detect an abnormality in the apparatus by sensing the temperature of a critical element or may comprise a small utensil detector which senses inadvertently placed small objects on the cooktop. The protection circuit provides a logical "1" when any of its monitoring items is abnormal to switch the NOR gate 116 to logical "0". When the apparatus is in operation, switch 120 is closed to provide a logical "0" to the NOR gate 116. Thus, NOR gate 116 provides a logical "1" when the apparatus is operating properly, as shown at G in FIG. 4.

The trigger circuit 117 includes a voltage comparator 122 having its inverting input coupled to the heating coil 4 and its noniverting input coupled through a voltage divider to the output of power circuit 111. The voltage applied to the inverting input of comparator 122 is shown at A in FIG. 4. This voltage is compared with the DC voltage of power circuit 111 (which is indicated by a broken line "a" in FIG. 4) in the comparator 122. A differentiator 123 is coupled to the output of the voltage comparator 122 to generate a pulse as shown at C in FIG. 4 which appears when the potential at the collector of transistor 6 drops below the DC voltage of power cirucit 111. A transistor 124 is coupled to the differentiator 123 to provide a low impedance path in response to pulses C.

The timing circuit 118 includes a programmable unijunction transistor 125 having its anode coupled to a junction between the resistor 127 and capacitor 128 of a time constant circuit. The bias potential (shown at "d" in FIG. 4) applied to the gate of the unijunction transistor 125 is derived from a voltage divider formed by resistors R1, R2 and R3 which divides the output voltage (waveform G) of the NOR gate 116. An NPN transistor 126 is provided having its base coupled between the resistors R2 and R3. The transistor 126 is turned on when the voltage at the junction between resistors R2 and R3 is higher than the threshold voltage thereof and turned off when the protection circuit 119 provides a logical "0" or when the unijunction transistor 125 is turned on. The value of the timing resistor 127 is selected so that once the unijunction transistor 125 is turned on an anode current of a sufficient magnitude flows into the transistor 125 to keep it conductive. To the junction between resistor 127 and capacitor 128 is connected the collector of transistor 124 of the trigger circuit 117. When the collector voltage of the power-rated switching transistor 6 drops below the reference level "a" (FIG. 4), the voltage comparator 122 produces an output by which the transistor 124 is briefly turned on. Thus, the potential at the anode of unijunction transistor 125 drops to zero, causing it to turn off. This turn-off state of transistor 125 continues until the voltage (shown at D in FIG. 4) charged into the capacitor 128 reaches the potential "d". Thus, the unijunction transistor 125 turns on during the period when the collector voltage of switching transistor 6 is higher than the threshold level "a".

Figure 4:
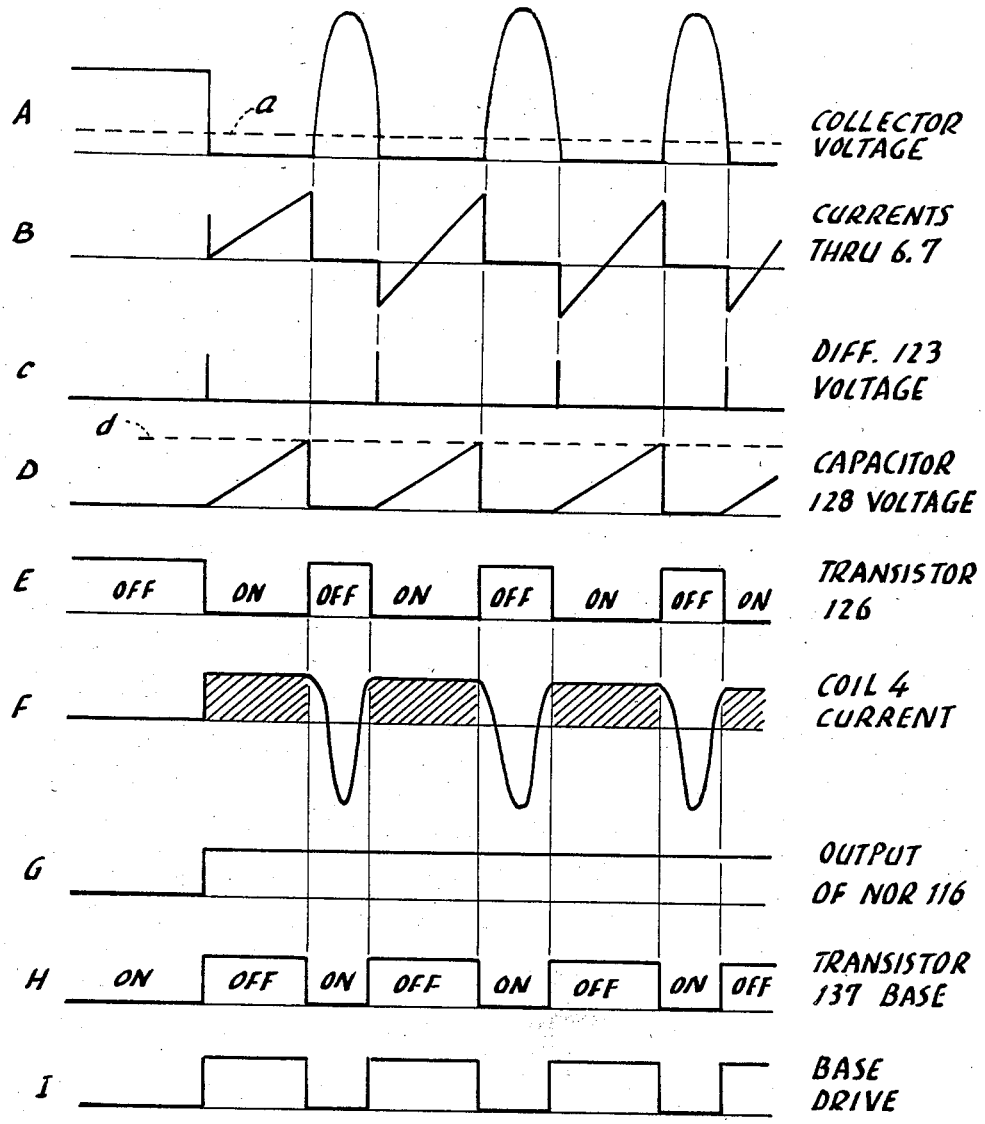
FIG. 4 is a waveform diagram associated with the second embodiment.

In this way, the transistor 126 of the timing circuit 118 is turned on during the period when the collector voltage of transistor 6 is lower than the threshold level "a" and is turned off during the period when that collector voltage rises above the threshold level as illustrated at E in FIG. 4. Since the time during which the transistor 126 remains conductive is determined by the resistor 127 and capacitor 128 of the timing circuit 118, it will be seen that by applying an inverted output of the transistor 126 to the base of the switching transistor 6 the latter will remain conductive for an interval determined by the resistor 127 and capacitor 128, resulting in the generation of a negative current, shown at F in FIG. 4, in the heating coil 4. Immediately following the turn-off of switching transistor 6, the resonant circuit formed by coil 4 and capacitor 5 is oscillated, causing a negative current to flow in the coil 4 as shown at F. Currents shown at B in FIG. 4 will be generated in the transistor 6 and diode 7.

One end of the transformer 9 is coupled to ground and the other end is coupled to the anode of a diode 132, the cathode of which is coupled to a circuit node 130 to which the collector of transistor 126 is also connected by an inverter 131 and a diode 133. The circuit node 130 is connected by a resistor 134 to the base of switching transistor 6. The diodes 132 and 133 form a circuit that passes the greater of the voltages applied respectively thereto to the circuit node 130. The voltage developed at the output of inverter 131 is determined so that it is normally lower than the voltage induced in the detector coil 9. Thus, under normal operating conditions, the detector coil 9 voltage is applied to the transistor 6 and therefore the inverter 131 output drives the transistor 6 only during such times as when the apparatus is in the first cycle of oscillation during startup periods and when the detector coil 9 voltage reduces to an abnormally low level.

The output of the transistor 126 is further connected by a pair of series-connected inverters 135 and 136 to the base of a transistor 137 whose collector-emitter path is connected between the base of transistor 6 and ground. The voltage applied to the transistor 137 is shown at H in FIG. 4. The transistor 137 thus serves to disable the switching transistor 6 during periods other than the periods in which a timing action is in progress in the timing circuit 118. According to a feature of the invention, this disabling action permits excess carriers stored in the base of transistor 6 to be quickly discharged through the transistor 137 to thereby shorten its turn-off time, while at the same time inhibiting the unwanted oscillating current which is generated in the detector coil 9 from being applied to the transistor 6. The current passing through the transistor 6 is not contaminated with noise as shown at I in FIG. 4. As a result of the disabling action, high speed switching operation, high inverter efficiency and stability can be achieved.

A still higher switching operation could be achieved by applying a reverse bias to the base of transistor 6 when it turns on through the emitter-collector path of transistor 137 since it enhances the discharging of excess carriers. In this instance, the emitter of transistor 137 is coupled to a negative voltage supply instead of being coupled to ground. Such a negative voltage may be derived from an additional secondary winding coupled to the primary of transformer 14 or by rectifying the voltage induced in the detector coil 9.

Figure 5:
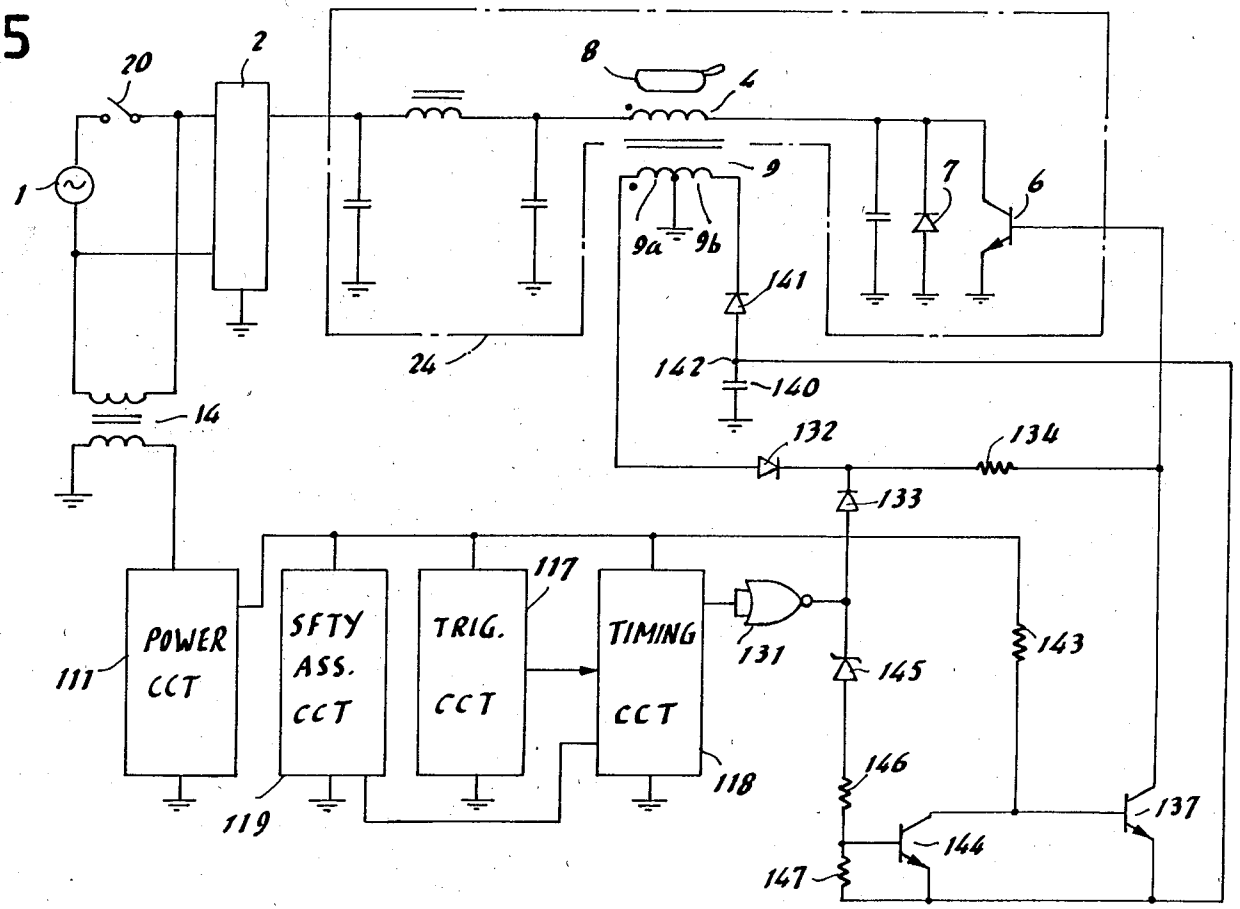
FIG. 5 is a block diagram of a third embodiment of the invention.

FIG. 5 is an illustration of a further embodiment in which the reverse potential for transistor 6 is derived to achieve higher switching operation. In this embodiment, the detector coil 9 has a center tap as in the FIG. 1 embodiment to generate high-frequency energies of opposite polarities in the coil sections 9*a* and 9*b*. The voltage developed in the coil section 9*b* is rectified by a diode 141 and smoothed out by means of a capacitor 140 which is grounded. A circuit node 142 between the anode of diode 141 and the capacitor 140 is connected to the emitter of the transistor 137. Instead of the inverters 135 and 136 of the FIG. 3 embodiment, a Zener diode 145 is connected in circuit with resistors 146 and 147 between the output of inverter 131 and the circuit node 142. A node between resistors 146 and 147 is connected to the base of a transistor 144 whose emitter is connected to the circuit node 142 and whose collector is connected to the base of transistor 137. The DC power line from the power circuit 111 is coupled by a resistor 143 to the base of transistor, 137 to supply a base current thereto. This base current is drained through the transistor 144 when the latter is turned on and no bias is applied to transistor 137. The transistor 144 is turned on when the Zener diode 145 is conductive. The Zener diode 145 is of the type whose breakdown voltage is greater than the voltage Va supplied on DC power line from the power circuit 111 and smaller than Va plus the reverse potential Vb at the circuit node 142. When the output of inverter 131 is driven to a logical "1", the transistor 144 is turned on diverting the base current of the transistor 137, thus causing the latter to turn off. The turn-off of transistor 137 enables the transistor 6 to be driven into conduction. In response to a logical "0" at the output of inverter 131 the transistor 144 is turned off to enable transistor 137 to turn on, causing the transistor 6 to turn off while at the same time applying the reverse potential Vb to the base of transistor 6 for a brief interval.

The inverter load may vary from a relatively small size utensil to a large pan. This produces a change in the resonance frequency of the inverter. Because of the feedback loop formed by the trigger circuit 117 taking its input from the collector of transistor 6, the frequency of the trigger pulse is automatically controlled to compensate for the change in resonance frequency so that the energy withdrawn to the utensil is adjusted to a level commensurate with the load size. As in the FIG. 1 embodiment in which the power adjustment is effected by user-controlled potentiometer, the feedback-controlled change in inverter output power does not affect the amount of high-frequency energy available for use in switching operation.

Figure 6A:
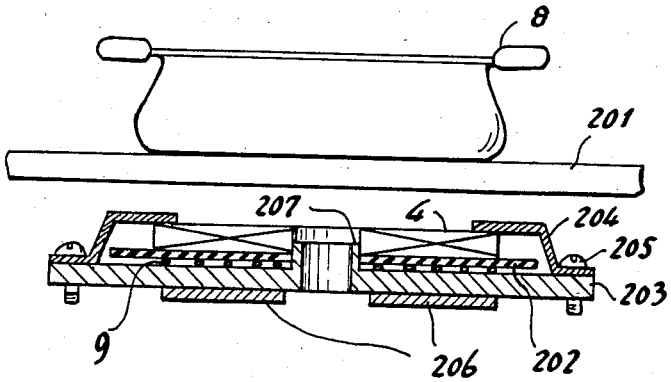
Figure 6B:
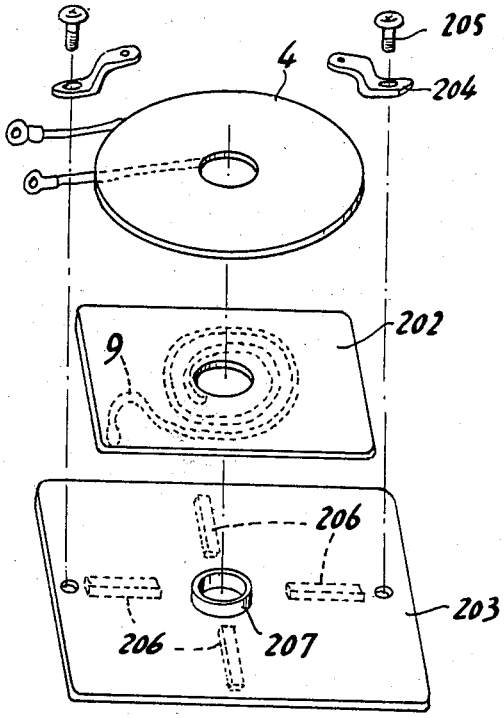

According to a practical embodiment of the invention, the detector coil 9 is mounted in a manner illustrated in FIGS. 6*a* and 6*b*. The induction heating coil 4 is of a flat, spiral configuration which is mounted on a heat-resistive insulator 202. The detector coil 9 is provided in the form of a spiral pattern of printed circuit on the surface of the insulator 202 opposite to the surface on which the heating coil 4 is mounted. The coils 4 and 9 are mounted on an insulative support 203 by means of a bracket 204 and screws 205. The coil structure is suitably secured in a position below a ceramic cooktop 201. The coil 4 and the insulator 202 are formed with aligned center apertures and the support 203 is formed with an upstanding ring 207 about a center aperture so that it provides for centering the coil 4 and the printed-circuit board 202 to hold the coils 4 and 9 in coaxial relationship. The arrangement just described allows a high degree of electromagnetic coupling between the coils 4 and 9 and provides a structural integrity to the coils. A preferred material for the insulator 202 is polyester or polyimide to achieve a desired electromagnetic coupling. The support 203 is provided on its underside with a plurality of angularly spaced apart nonconductive members 206 having a high permeability such as ferrite bars. These ferrite bars concentrate the magnetic flux lines which would otherwise affect other circuit components mounted below. This increases the electromagnetic coupling between coils 4 and 9.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. An induction heating apparatus comprising a rectifier for rectifying a voltage from an AC mains supply, a resonance circuit formed by an induction heating coil and a capacitor, a unidirectionally conductive semiconductor switching device connected in circuit with said resonance circuit to the output of said rectifier, a unidirectionally conducting device coupled in anti-parallel relationship with said switching device, a circuit for driving said switching device into conduction at a controlled frequency, first means for deriving a low-frequency energy from said AC mains supply, a second coil electromagnetically coupled with said heating coil for deriving a high-frequency energy, and second means for applying said low-frequency energy and said high-frequency energy to said driving circuit to provide power necessary to effect the condition of said switching device, said second means including means for applying the greater of said low-frequency and high-frequency energies to said driving circuit.

2. An induction heating apparatus as claimed in claim 1, further comprising a smoothing capacitor for smoothing out said low-frequency energy into a DC energy.

3. An induction heating apparatus as claimed in claim 2, wherein said driving circuit comprises a pulse generating means powered by said DC energy for generating a train of trigger pulses at a controlled frequency, a first diode coupling said trigger pulse to a circuit node, inverter means for inverting said trigger pulses, means for disabling said switching device in response to the inverted pulses, and a second diode coupling said high-frequency energy to said circuit node, said circuit node being coupled by a resistor to said switching device.

4. An induction heating apparatus as claimed in claim 3, wherein said second coil includes a center tap coupled to a reference potential to generate high-frequency energies of opposite sense at the terminals thereof, further comprising means coupled to one of the terminals of said second coil for deriving a potential having an opposite polarity to the potential neccessary to drive said switching device into conduction, and wherein said disabling means comprises a transistor having a base coupled to be responsive to said inverted pulses and a collector-emitter path coupling said opposite polarity potential to said switching device.

5. An induction heating apparatus as claimed in claim 4, wherein said opposite polarity potential deriving means comprises a diode and a smoothing capacitor connected in circuit from one of the terminals of said second coil to the reference potential.

6. An induction heating apparatus comprising a rectifier for rectifying a voltage from an AC mains supply, a resonance circuit formed by an induction heating coil and a capacitor, a unidirectionally conductive semiconductor switching device connected in circuit with said resonance circuit to the output of said rectifier, a unidirectionally conducting device coupled in anti-parallel relationship with said switching device, a circuit for driving said switching device into conduction at a controlled frequency, first means for deriving a low-frequency energy from said AC mains supply, a second coil electromagnetically coupled with said heating coil for deriving a high-frequency energy, and second means for applying said low-frequency energy and said high-frequency energy to said driving circuit to provide power necessary to effect the conduction of said switching device, said first means comprising a transformer having a primary winding coupled to said AC mains supply, a pair of first diodes oppositely coupled to a secondary winding of said transformer, and a pair of smoothing capacitors coupled to said first and second diodes respectively to derive positive and negative DC voltages at first and second circuit nodes, and said second coil including a center tap connected to a reference potential to generate high frequency energies of opposite sense at the terminals thereof, further comprising a pair of second diodes oppositely coupled between the terminals of said second coil and said first and second circuit nodes, respectively, said first and second circuit nodes being coupled to said driving circuit.

7. An induction heating apparatus comprising a rectifier for rectifying a voltage from an AC mains supply, a resonance circuit formed by an induction heating coil and a capacitor, a unidirectionally conductive semiconductor switching device connected in circuit with said resonance circuit to the output of said rectifier, a unidirectionally conducting device coupled in anti-parallel relationship with said switching device, a circuit for driving said switching device into conduction at a controlled frequency, first means for deriving a low-frequency energy from said AC mains supply, a second coil electromagnetically coupled with said heating coil for deriving a high-frequency energy, and second means for applying said low-frequency energy and said high-frequency energy to said driving circuit to provide power necessary to effect the conduction of said switching device, and means for generating a potential having an opposite polarity to the potential necessry to drive said switching device into conduction and applying the opposite polarity potential to said switching device when same switches from a conducting state to a nonconducting state.

8. An induction heating apparatus comprising a rectifier for rectifying a voltage from an AC mains supply, a resonance circuit formed by an induction heating coil and a capacitor, a unidirectionally conductive semiconductor switching device connected in circuit with said resonance circuit to the output of said rectifier, a unidirectionally conducting device coupled in anti-parallel relationship with said switching device, a circuit for driving said switching device into conduction at a controlled frequency, first means for deriving a low-frequency energy from said AC mains supply, a second coil electromagnetically coupled with said heating coil for deriving a high-frequency energy, and second means for applying said low-frequency energy and said high-frequency energy to said driving circuit to provide power necessary to effect the conduction of said switching device, wherein said induction heating coil is of a flat, spiral configuration mounted on one surface of an insulator, and said second coil comprising a spiral pattern of printed conductive film on the other surface of said insulator in coaxial relationship with said heating coil.

9. An induction heating apparatus as claimed in claim 8, further comprising a high permeability, nonconductive member and insulative support sandwiched between said member and said printed conductive film.

10. An induction heating apparatus comprising a rectifier for rectifying a voltage from an AC mains supply, a resonance circuit formed by an induction heating coil and a capacitor, an unidirectionally conductive semiconductor switching device connected in circuit with said resonance circuit to the output of said rectifier, a unidirectionally conducting device coupled in anti-parallel relationship with said switching device, a circuit for driving said switching device into conduction at a controlled triggering frequency, means for deriving a low-frequency energy from said AC mains supply, a second coil electromagnetically coupled with said heating coil for deriving a high-frequency energy, and feedback control means for controlling said triggering frequency of said switching device responsively to changes in the high-frequency of the heating coil determined by said resonance circuit, said feedback control means including timing means for controlling timing of operation of said switching means, additional switching means for controlling operation of said switching means to enable said switching means only when said timing means operates to control said switching means, thereby permitting rapid discharge of excess carriers stored therein during turn-off thereof, further comprising initializing means operable for driving said switching means only in a first cycle of operation during a start-up period and when an output from said second coil is below a predetermined level.

11. An induction heating apparatus as claimed in claim 10 further comprising zener diode means for turning said additional switching means on and off thereby controlling said switching means, said zener diode means connected to said initializing means.

* * * * *